US006474375B2

(12) United States Patent
Spero et al.

(10) Patent No.: US 6,474,375 B2
(45) Date of Patent: Nov. 5, 2002

(54) RECONSTITUTION DEVICE AND METHOD OF USE

(75) Inventors: Richard Spero; Adam Hagmann, both of Brentwood; Terry E. Laas, Palm Desert, all of CA (US)

(73) Assignee: Baxter International Inc., Deerfield, IL (US)

( * ) Notice: Subject to any disclaimer, the term of this patent is extended or adjusted under 35 U.S.C. 154(b) by 0 days.

(21) Appl. No.: 09/776,351

(22) Filed: Feb. 2, 2001

(65) Prior Publication Data

US 2002/0104584 A1 Aug. 8, 2002

(51) Int. Cl.[7] ..... B65B 1/04
(52) U.S. Cl. ..... 141/329; 141/59; 604/416
(58) Field of Search ..... 141/329, 330, 141/59, 65, 66, 19, 9, 100; 604/411–416

(56) References Cited

U.S. PATENT DOCUMENTS

| | | | | |
|---|---|---|---|---|
| 2,584,397 | A | * | 2/1952 | Pitman |
| 3,343,538 | A | | 9/1967 | Morley |
| 4,038,981 | A | | 8/1977 | LeFevre et al. |
| 4,246,932 | A | | 1/1981 | Raines |
| 4,252,159 | A | | 2/1981 | Maki |
| 4,378,013 | A | | 3/1983 | LeFevre |
| 4,401,432 | A | | 8/1983 | Schwartz |
| 4,433,974 | A | | 2/1984 | Bischof |
| 4,434,820 | A | | 3/1984 | Glass |
| 4,516,967 | A | | 5/1985 | Kopfer |
| 4,543,101 | A | | 9/1985 | Crouch |
| 4,564,054 | A | | 1/1986 | Gustavsson |
| 4,568,346 | A | | 2/1986 | van Dijk |
| 4,576,211 | A | | 3/1986 | Valentini et al. |
| 4,675,020 | A | | 6/1987 | McPhee |
| 4,715,851 | A | | 12/1987 | Geissner et al. |
| 4,722,733 | A | | 2/1988 | Howson |

(List continued on next page.)

FOREIGN PATENT DOCUMENTS

| | | | |
|---|---|---|---|
| EP | 0570939 | A1 | 11/1993 |
| EP | 0592689 | A1 | 4/1994 |
| EP | 0884041 | A2 | 12/1998 |
| FR | 3811152 | A1 | 10/1988 |
| WO | WO 96/29113 | A1 | 9/1996 |
| WO | WO 9710156 | A1 | 3/1997 |
| WO | WO 97/20536 | A1 | 6/1997 |
| WO | WO 9802129 | A1 | 1/1998 |

*Primary Examiner*—Steven O. Douglas
(74) *Attorney, Agent, or Firm*—Oppenheimer, Wolff & Donnelly LLP

(57) ABSTRACT

A method and apparatus for reconstituting a multiple component material is disclosed. More particularly, the present invention discloses an apparatus utilizing an operator controllable pressurization device to generate a pressure differential between two receptacles attached to the device. The receptacles may contain individual components of a multiple component material, and may include liquid-liquid or liquid-solid compounds. The apparatus includes a material transfer lumen attachable to a first and second component receptacle. A pressurization lumen is connected to one of the component receptacles to facilitate material transfer. One embodiment of the present invention utilizes a negative pressure differential created in the second receptacle to facilitate transfer. In another embodiment, a positive pressure is created in the first receptacle to force material transfer between the two receptacles.

17 Claims, 6 Drawing Sheets

U.S. PATENT DOCUMENTS

| | | | |
|---|---|---|---|
| 4,729,401 | A | 3/1988 | Raines |
| 4,768,568 | A | 9/1988 | Fournier et al. |
| 4,787,898 | A | 11/1988 | Raines |
| 4,834,149 | A | 5/1989 | Fournier et al. |
| 4,856,567 | A | 8/1989 | Cosmai |
| 4,883,483 | A | 11/1989 | Lindmayer |
| 4,900,322 | A | 2/1990 | Adams |
| 4,927,423 | A | 5/1990 | Malmborg |
| 4,936,841 | A | 6/1990 | Aoki et al. |
| 5,045,081 | A | 9/1991 | Dysarz |
| 5,114,411 | A | 5/1992 | Haber et al. |
| 5,188,615 | A | 2/1993 | Haber et al. |
| 5,304,165 | A | 4/1994 | Haber et al. |
| 5,330,426 | A | 7/1994 | Kriesel et al. |
| 5,342,346 | A | 8/1994 | Honda et al. |
| 5,348,548 | A | 9/1994 | Meyer et al. |
| 5,350,372 | A | 9/1994 | Ikeda et al. |
| 5,360,410 | A | 11/1994 | Wacks |
| 5,397,303 | A | 3/1995 | Sancoff et al. |
| 5,445,631 | A | 8/1995 | Uchida |
| 5,466,220 | A | 11/1995 | Brenneman |
| 5,526,853 | A | 6/1996 | McPhee et al. |
| 5,531,683 | A | 7/1996 | Kriesel et al. |
| 5,603,695 | A | 2/1997 | Erickson |
| 5,624,638 | A | 4/1997 | Negrotti |
| 5,873,872 | A | 2/1999 | Thibault et al. |
| 5,876,372 | A | 3/1999 | Grabenkort et al. |
| 5,925,029 | A | 7/1999 | Jansen et al. |
| 5,928,213 | A | 7/1999 | Barney et al. |
| 5,944,709 | A | 8/1999 | Barney et al. |
| 5,954,696 | A | 9/1999 | Ryan |
| 6,003,566 | A | 12/1999 | Thibault et al. |
| 6,117,123 | A | 9/2000 | Barney et al. |

* cited by examiner

RECONSTITUTION DEVICE AND METHOD OF USE

BACKGROUND OF THE INVENTION THE DEVICE

Many drugs administered to patients comprise a compound of medicament components mixed shortly before use. Oftentimes it is necessary to store these substances in separate receptacles until use. Reconstitution of the compound may require the mixing of a liquid-phase component and a solid-phase component, or the mixing of two liquid-phase components. Commonly, the solid-phase component is in powder form to permit stable storing of a component. The receptacles used to store these components may be constructed of glass, plastic, or other suitable material.

One way currently used to reconstitute material requires a first component to be injected with a syringe into a receptacle containing a second component. For example, a syringe having a needle attached thereto is inserted through the rubber membrane top of a receptacle containing a first liquid-phase component, and the liquid-phase component is withdrawn into the syringe barrel. The needle is then removed from the liquid-phase component receptacle. Subsequently, the needle of the syringe is inserted through the rubber membrane top of the second liquid-phase or solid-phase component receptacle, and the liquid-phase component is injected from the syringe barrel into the second receptacle. The second receptacle is shaken to mix the components. Thereafter, a needle, attached to a syringe, is inserted through the rubber membrane top, the component mixture is drawn into the syringe barrel, and the needle is removed from the receptacle. The component mixture may then be administered.

An improvement to this process is the subject of U.S. Pat. No. 5,445,631, entitled "Fluid Delivery System", to Tadatoshi et al. The device of that invention includes a double-ended spike containing a lumen. The problem created by the device disclosed therein failed to address pressurize equalization between the individual component containers. As a result, the rate of material transfer is in constant fluctuation due to thermodynamic issues.

These problems were addressed in WO 96/29112, entitled "Fluid Control Device", to Handelman et al. The Handelman device utilizes pressurized component vials storing their contents under a high vacuum to create a pressure differential.

With respect to these devices, it is desirable to have a system capable of reconstituting a multiple component material using commercially available component storage receptacles. Additionally, it is desirable to have a reconstitution system wherein the operator may control the rate of reconstitution. Yet another problem associated with drug reconstitution is that some drugs, e.g. drugs used for chemotherapy, may be hazardous to hospital personnel. It is, thus, also desirable to have a reconstitution device and method that reduces or eliminates the possibility of inadvertent needle sticks.

BRIEF SUMMARY OF THE INVENTION

The present invention discloses a method and apparatus for reconstituting a multiple component material. More particularly, the present invention discloses a method and apparatus utilizing an operator-controlled pressurization differential to transfer and reconstitute solutions. The individual components may comprise liquid-liquid, or liquid-solid mixtures. For example, the present invention is especially useful for reconstituting a fibrinogen-based tissue sealant. Another use of the present invention involves the reconstitution of multiple component chemotherapy drugs. In sum, the present invention in its broadest sense should not be construed to be limited to any particular multiple component materials, although particular examples may be shown and disclosed.

In one embodiment, a first receptacle receiver having at least a material flow lumen and a pressure lumen in communication therewith is in fluid communication with a second receptacle receiver through said material flow lumen. A user-controllable source of positive pressure is used to create a pressurization differential between the first and second receptacles, thereby resulting in transfer of the materials.

In yet another embodiment, a first receptacle receiver having at least a material flow lumen in communication therewith is in fluid communication through said material flow lumen with a second receptacle receiver having a pressure lumen in communication therewith. A user-controllable source of negative pressure is used to create a pressurization differential between the first and second receptacles, thereby resulting in a material transfer.

Also disclosed in the present invention is a method of reconstituting a solution, comprising the steps of creating fluid communication between a first receptacle and a second receptacle, and creating a pressure differential between said first receptacle and said second receptacle, thereby causing the contents of the first receptacle to flow into said second receptacle.

Other objects, features, and advantages of the present invention will become apparent from a consideration of the following detailed description.

BRIEF DESCRIPTION OF THE DRAWINGS

The apparatus of the present invention will be explained in more detail by way of the accompanying drawings, wherein.

DETAILED DESCRIPTION OF THE INVENTION

Disclosed herein is a detailed description of various illustrated embodiments of the present invention. This description is not to be taken in a limiting sense, but is made merely for the purpose of illustrating the general principles of the invention. The section titles and overall organization of the present detailed description are for the purpose of convenience only and are not intended to limit the present invention.

The reconstitution device of the present invention is used to facilitate the transfer of components between separate component receptacles. More particularly, the present invention permits the user to create a pressure differential between a first component receptacle and a second component receptacle, thereby enabling efficient material transfer between receptacles. The present invention enables the operator to transfer material from commercially available component receptacles with increased user safety. In addition to increasing safety, the present invention greatly reduces the likelihood of material contamination. As those skilled in the art will appreciate, the present invention is simple and inexpensive to manufacture and utilizes existing component receptacles. It is anticipated as being within the scope of the present invention to produce a reconstitution device capable of functionally coupling with a plurality of component receptacles in a plurality of sizes.

Figure 1:
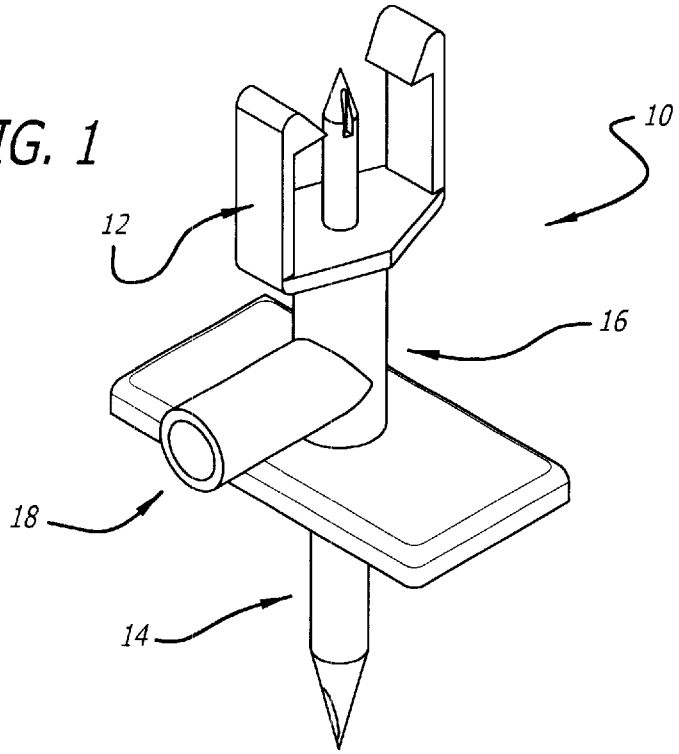
FIG. 1 is a side elevation view of an embodiment of the reconstitution device of the present invention.

FIG. 1 shows an apparatus 10 for reconstituting a multiple component material having a first receptacle receiver 12, a second receptacle receiver 14, a device body 16 positioned therebetween, and a vacuum device interface 18. As those skilled in the art will appreciate the present invention may be manufactured in a plurality of sizes to accommodate a variety of receptacle sizes. The apparatus 10 may be constructed of a plurality of materials, including, without limitation, polyethylene, polypropylene, polystyrene, or a like material.

Figure 2:
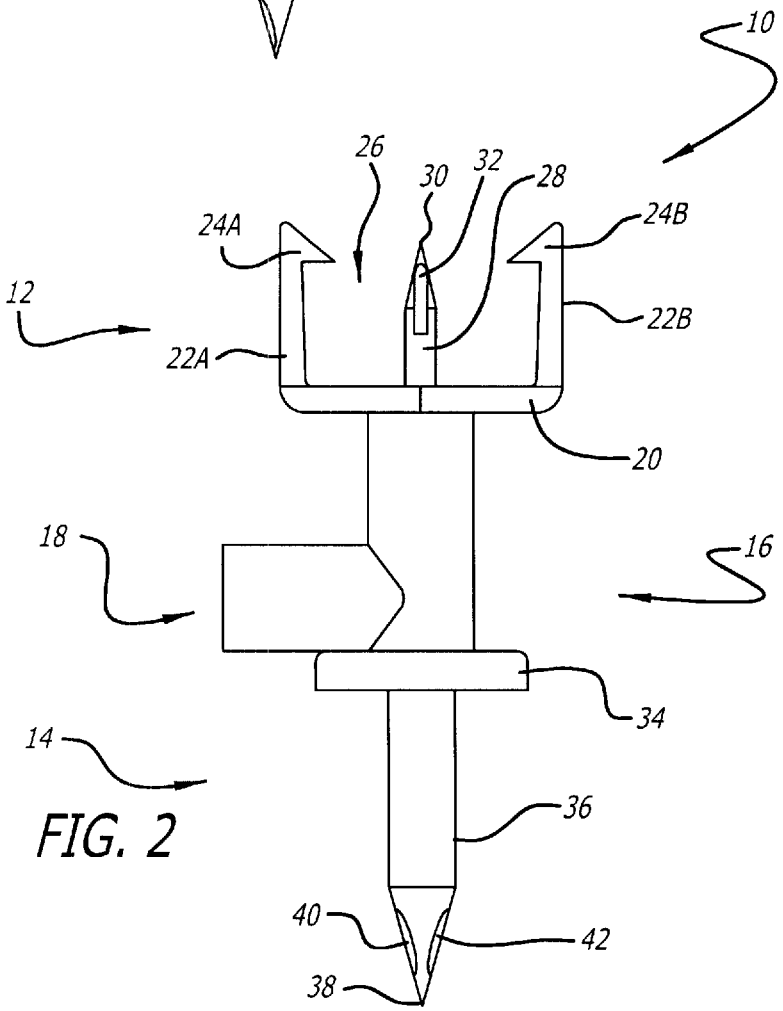
FIG. 2 is a side view of the reconstitution device illustrated in FIG. 1.

As shown in FIG. 2, the apparatus 10 comprises a first receptacle receiver 12 having a first receptacle stop 20 and receptacle support members 22*a* and 22*b* terminating in receptacle locking members 24*a* and 24*b*. A first receptacle orifice 26 is formed by the first receptacle stop 20 and may include receptacle support members 22*a* and 22*b*. If desired, alternate embodiments of the present invention may be manufactured without the receptacle support members 22*a* and 22*b*. Positioned within the first receptacle orifice 26 is a first component cannula 28 having a first pointed tip 30 and a first component withdrawal port 32. The second receptacle receiver 14 comprises a second receptacle stop 34 and a second component cannula 36 having a second pointed tip 38 and disposing a vacuum port 40 and a transfer port 42. Interposed between the first receptacle receiver 12 and the second receptacle receiver 14 is a device body 16 having a pressurization interface 18 positioned thereon.

Figure 3:
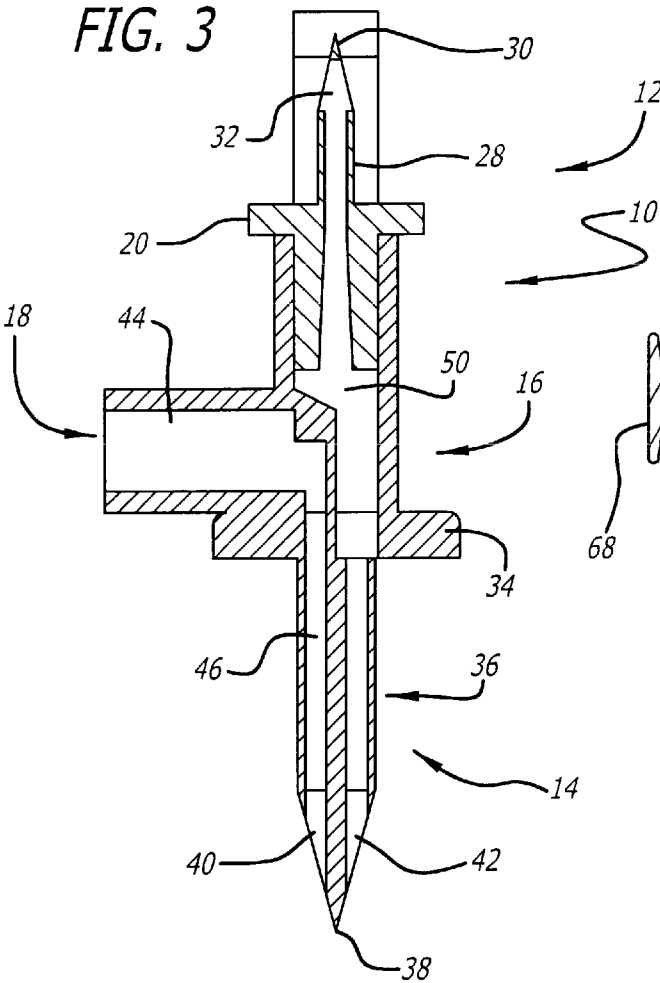
FIG. 3 is a side cross-sectional view of the reconstitution device illustrated in FIG. 1.

FIG. 3 shows a sectional view of the present invention. As shown in FIG. 3, the pressurization interface 18 forms a pressurization orifice 44, which is in communication with the pressurization port 40 through pressurization lumen 46 located within the second cannula 36. The transfer lumen 50, located adjacent to the pressurization lumen 46 within the second cannula 36, terminates at the transfer port 42 and is in communication with the withdrawal port 32 located on the first cannula 28.

Figure 4:
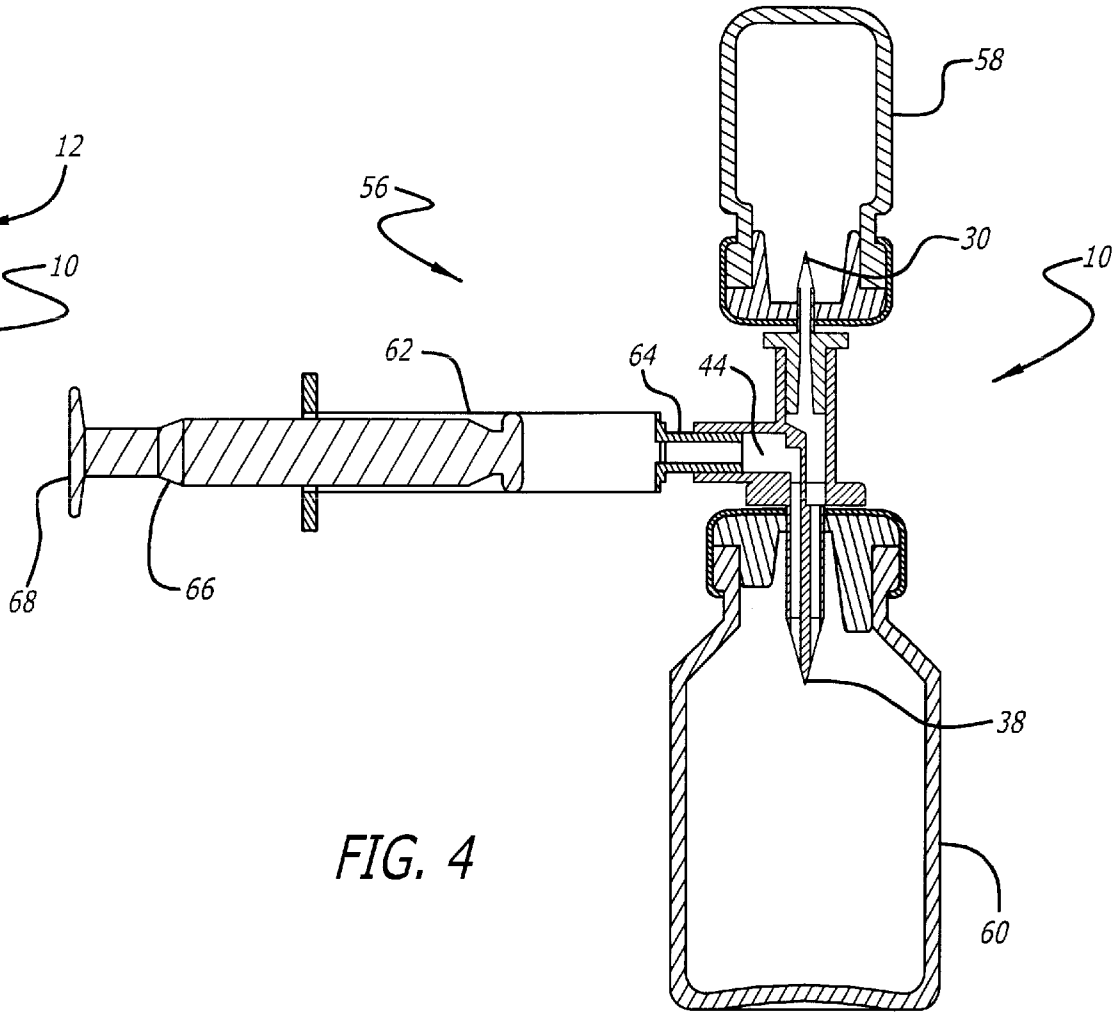
FIG. 4 is a side cross-sectional view of the reconstitution device of the present invention utilizing a syringe to provide a pressure differential.

FIG. 4 shows the present invention using a syringe 56 as a pressurization device. The syringe 56 comprises a syringe body 62, a syringe distal tip 64, a syringe plunger 66, and a syringe pusher 68. The syringe distal tip 64 is positioned within the pressurization orifice 44 formed by the pressurization interface 18. A first receptacle 58 is positioned within the first receptacle receiver 12 such that receptacle locking members 24*a* and 24*b* securely position the first receptacle 58 within the receptacle orifice 26. A second receptacle 60 is positioned within the second receptacle receiver 14. As shown in FIG. 4, locating the first receptacle 58 within the first receptacle receiver 12 results in the first pointed tip 30 of the first cannula 28 piercing the sealing material (not shown) of the first receptacle 58, thereby positioning the first cannula 28 within the first receptacle 58. Likewise, locating the second receptacle 60 within the second receptacle receiver 14 results in the second pointed tip 38 of the second cannula 36 piercing the sealing material (not shown) of the second receptacle 60, thereby positioning the second cannula 36 within the second receptacle 60. The first cannula 28 and the second cannula 36 may be manufactured from a plurality of materials, including, without limitation, polyethylene, polypropylene, polystyrene, stainless steel, or a like material.

Figure 6:
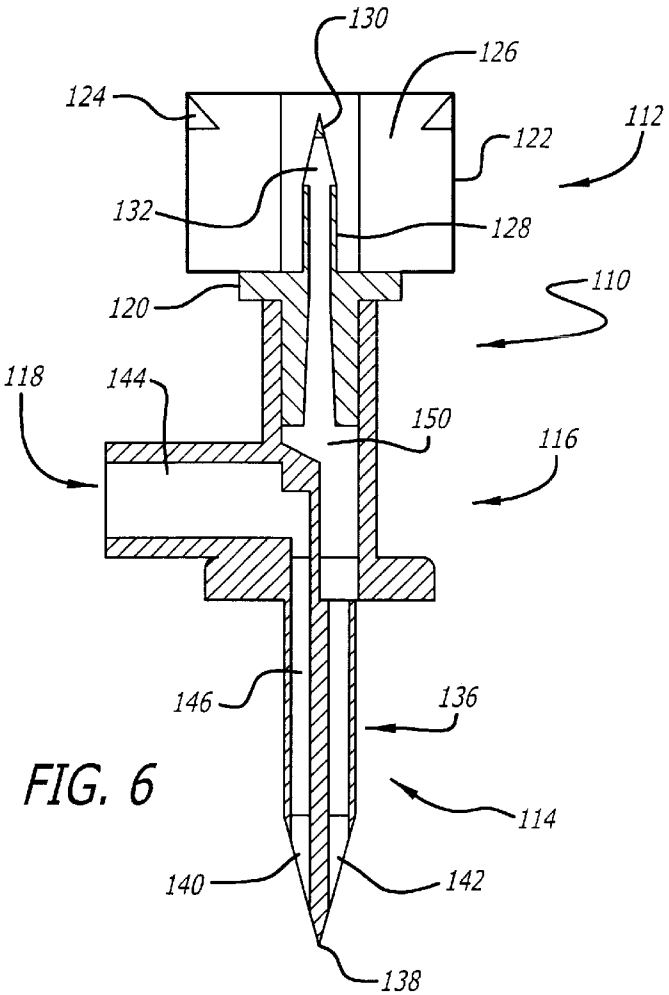
FIG. 6 is a side cross-sectional view of the reconstitution device illustrated in FIG. 5.
Figure 5:
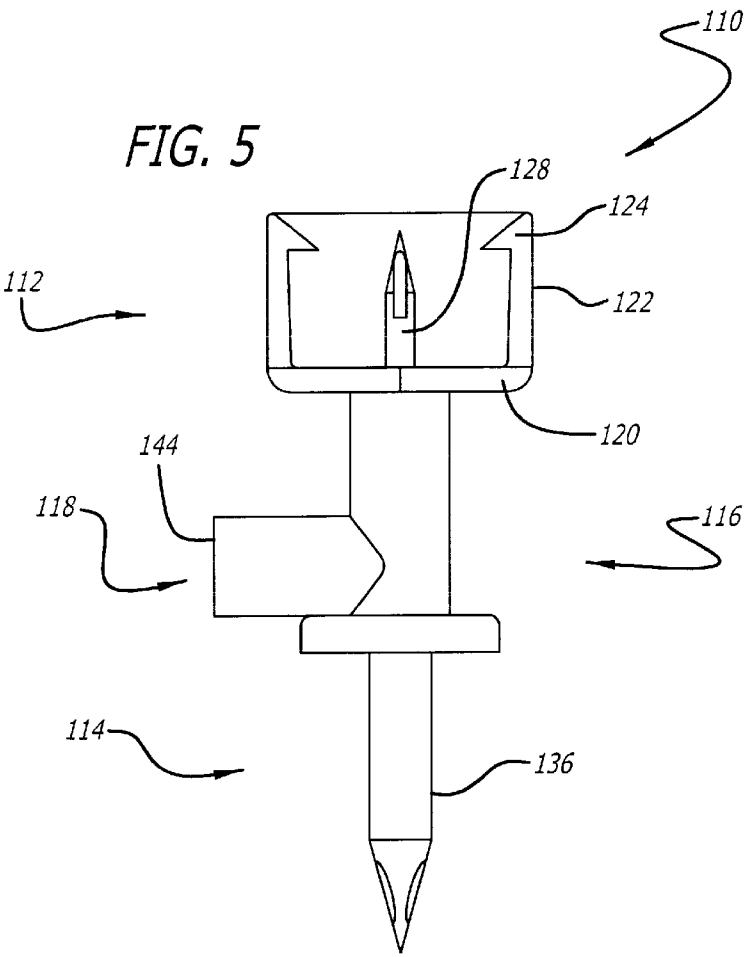
FIG. 5 is a side view of another embodiment of the reconstitution device of the present invention having an enclosed first receptacle receiver.

A second embodiment of the present invention is illustrated in FIGS. 5 and 6. The reconstitution device 110 includes a first receptacle receiver 112, a second receptacle receiver 114, a device body 116 positioned therebewteen, and a vacuum device interface 118. Like the previous embodiment, the present embodiment may be manufactured in a plurality of sizes and shapes to accommodate various component receptacles. The present embodiment includes an encapsulated first receptacle receiver 112, formed by first receptacle stop 120 and a continuous receptacle support member 122 defining a first receptacle orifice 126. At least one receptacle locking member 124 is positioned on the receptacle support member 122 and located within the first receptacle orifice 126.

As shown in FIGS. 5 and 6, the multiple internal lumen configuration of the present embodiment is similar to the previous embodiment. The pressurization interface 118 forms a pressurization orifice 144, which is in communication with the pressurization port 144 through the pressurization lumen 146 located within the second cannula 136. The transfer lumen 150, located adjacent to the pressurization lumen 146 within the second cannula 136, terminates at the transfer port 142 and is in communication with the withdrawal port 132 located on the first cannula 128 located within the first receptacle orifice 126.

Figure 7:
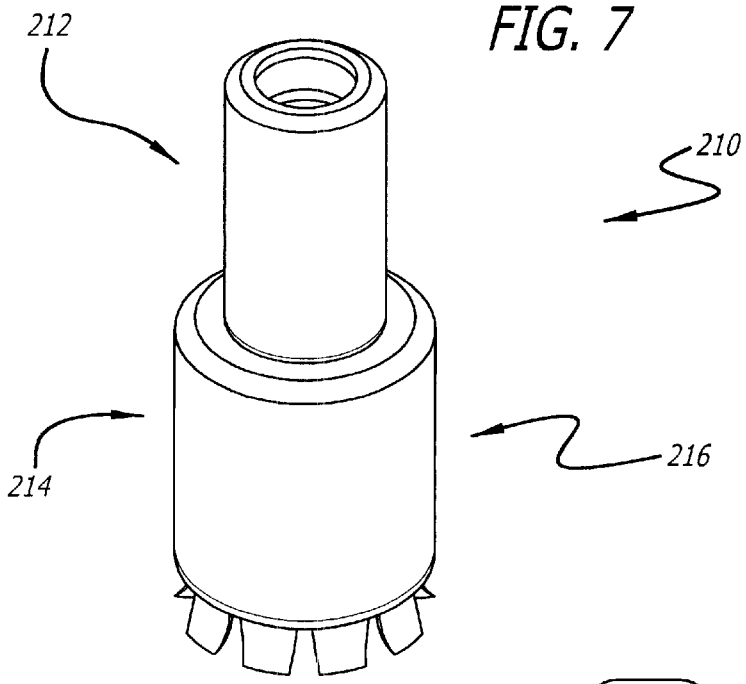
FIG. 7 is a side elevation view of another embodiment of the reconstitution device of the present invention.
Figure 8:
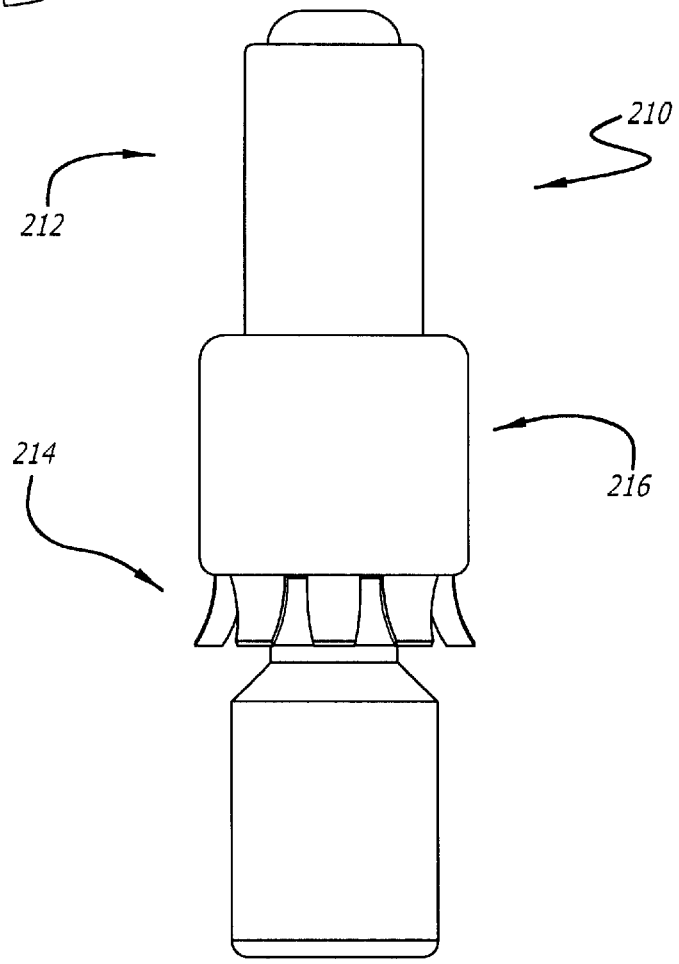
FIG. 8 is a side view of the reconstitution device illustrated in FIG. 7 having a first receptacle and second receptacle connected to the device.

FIGS. 7 and 8 shows a third embodiment of the present invention. The apparatus 210 comprises a first receptacle receiver 212, a second receptacle receiver 214, and a device body 216 positioned therebewteen. Like the previous embodiment, the present embodiment may be manufactured in a plurality of sizes and shapes to accommodate various component receptacles.

Figure 9:
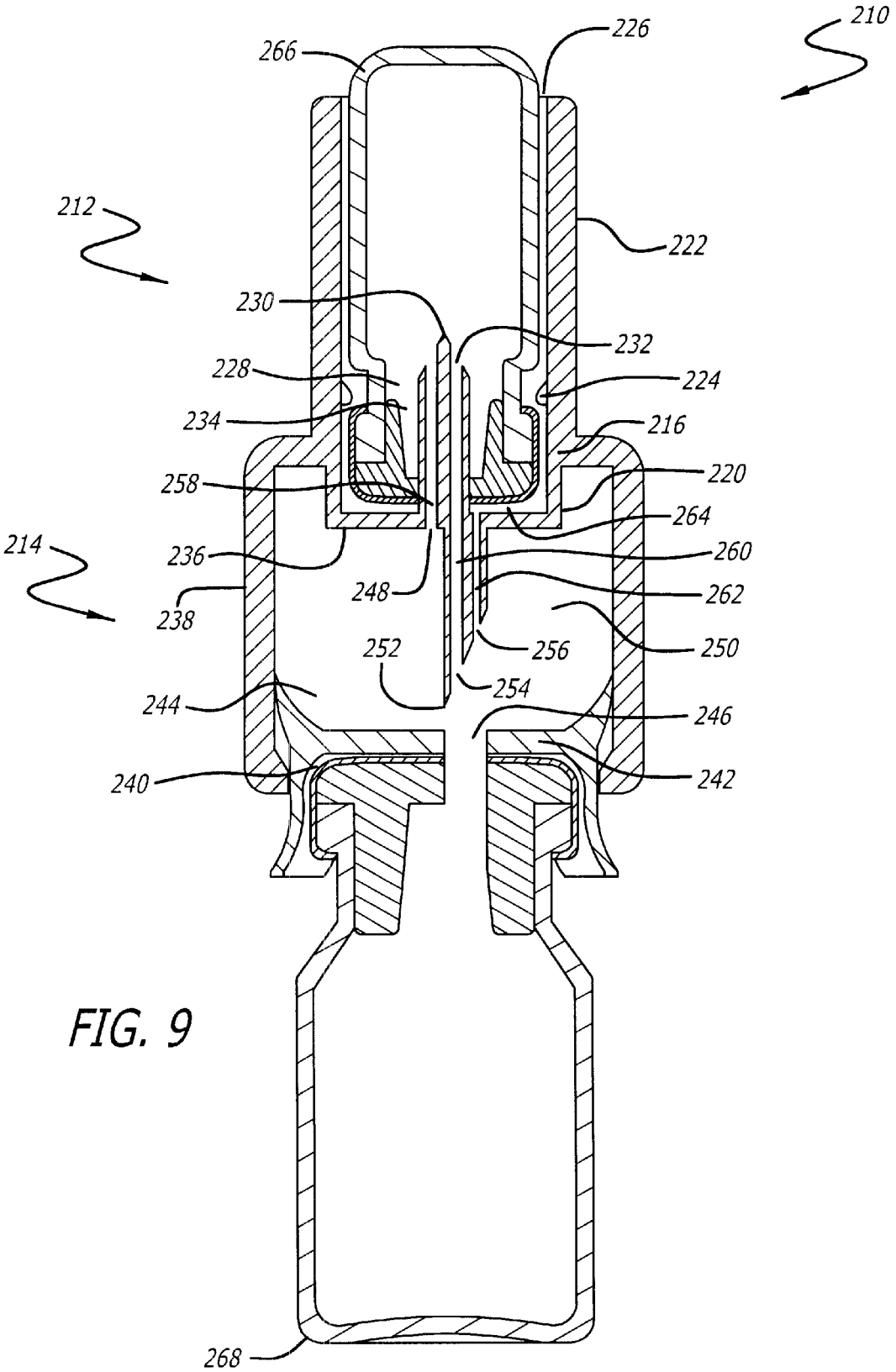
FIG. 9 is a side cross-sectional view of the reconstitution device illustrated in FIG. 7 showing the device prior to use.
Figure 10:
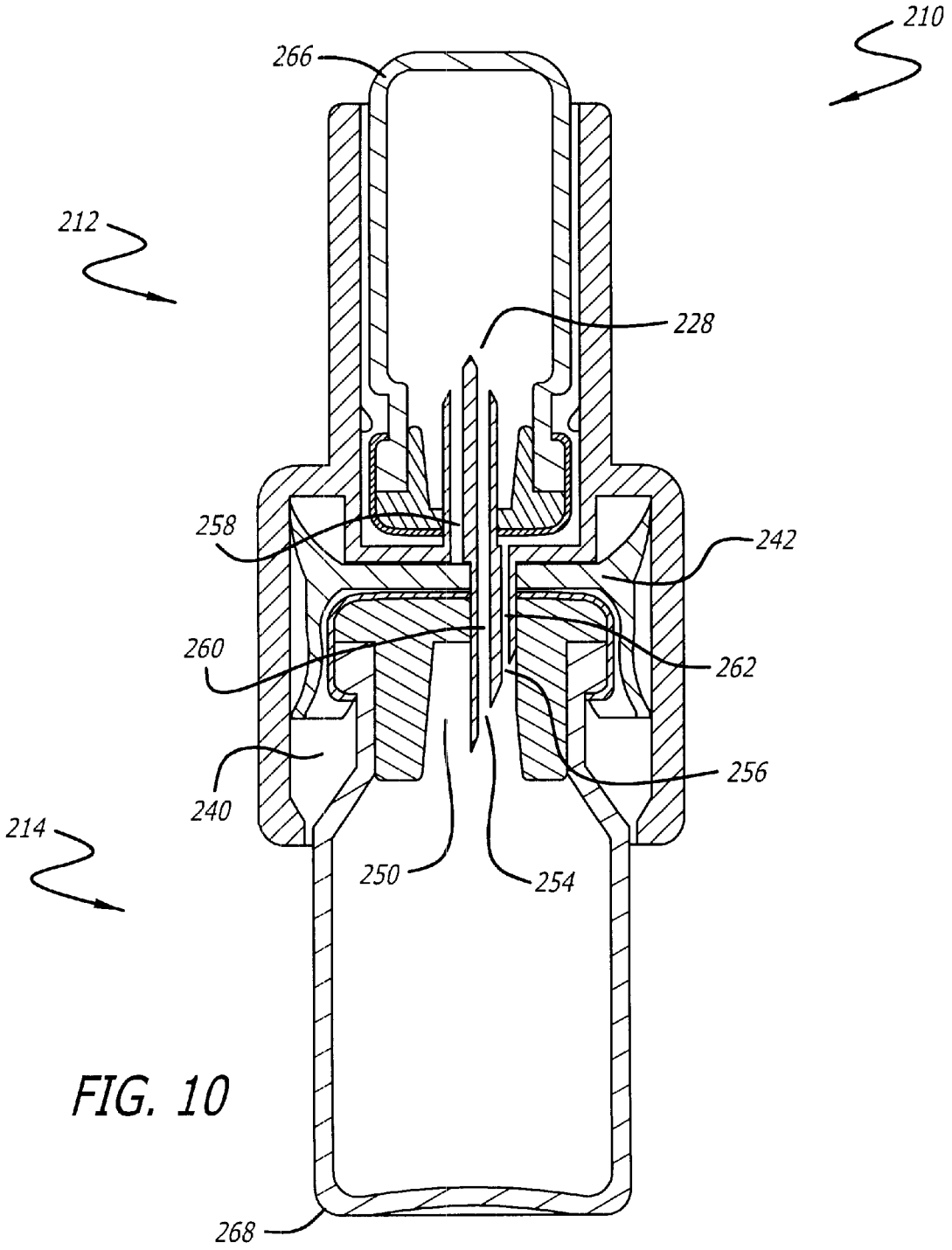
FIG. 10 is a side cross-sectional view of the reconstitution device illustrated in FIG. 7 showing the device in use.

FIGS. 9 and 10 show the present embodiment during various stages of use The first receptacle receiver 212 comprises a first receptacle stop 220 and a first receptacle support member 222 terminating with at least one receptacle locking member 224. A first receptacle orifice 226 is formed by the first receptacle stop 220 and the first receptacle support member 222. The first receptacle orifice 226 comprises a first multi-lumen component cannula 228 having a first pointed tip 230, a first component withdrawal port 232 and a pressurization port 234. The second receptacle receiver 214 comprises a second receptacle stop 236 and a second. receptacle support member 238. A second receptacle orifice 240 is formed by the second receptacle stop 236 and the second receptacle support member 238. A pressurization piston 242, which sealably interacts with the second receptacle support member 238, is slidably positioned within the second receptacle orifice 240, thereby forming a compression chamber 244. A cannula port 246 is positioned on the pressurization piston 242. At least one pressure transfer port 248 is located on the second receptacle stop 236. The second multi-lumen cannula 250 is connected to the second receptacle stop 236 and comprises a pointed tip 252, a material transfer port 254 and a venting port 256. The device body 216, positioned between the first receptacle receiver 212 and the second receptacle receiver 214, comprises a pressurization lumen 258, a material transfer lumen 260, a venting lumen 262, and a venting orifice 264. The pressurization lumen 258 is in fluid communication with the pressurization port 234 located on the first cannula 228 and the pressure transfer port 248 located within the compression chamber 244. The material transfer lumen 260 is in fluid communication with the first component withdrawal port 236 and the material transfer port 254. The venting lumen 262 is in fluid communication with the venting port 256 and a venting orifice 264 located on the device body 216.

The present invention comprises various methods for reconstituting a multiple component material. More specifically, the method permits the reconstitution of a material from multiple component receptacles which are in fluid communication. An operator controlled pressure differential is created to effect a transfer of materials between the receptacles.

A first method of reconstitution, which can be practiced with the apparatus shown in FIGS. 1–6, utilizes a negative pressure formed in the second receptacle 60. Alternatively, the method may be practiced by the introduction of a positive pressure introduced to the first receptacle 58, followed by the introduction of a negative pressure into the second receptacle 60. For example, a first receptacle 58 is positioned within the first receptacle receiver 12, wherein the first cannula 28 is in fluid communication with the material stored therein. A second receptacle 60 is positioned within the second receptacle receiver 14, such that the second cannula 36 is located within the second receptacle 60. A syringe 56, for example, may be coupled to the pressurization interface 18, wherein the syringe distal tip 64 is positioned within the pressurization orifice 44. It should be understood that alternative instruments may be used to create a pressure differential, including, for example, a mechanical vacuum device. A pressure differential is created within the second receptacle 60 as the syringe plunger 66 is retracted from the syringe barrel 62. The negative pressure differential created within the second receptacle results in the first component traversing the transfer lumen 50 and entering the second receptacle 60. Alternatively, the user may first inject air into the second receptacle 60 with the syringe 56. The injected gas causes a positive pressure differential, which equalizes within the first receptacle 58 and second receptacle 60. The subsequent retraction of the syringe plunger 66 results in the creation of a negative pressure differential within the second receptacle 60. Those skilled in the art will appreciate the present embodiment provides for the reconstitution of a multiple component material without introducing an ambient gas or material, thereby reducing the likelihood of contamination.

Yet another embodiment of the method of reconstituting a material is disclosed herein. This embodiment may be practiced by utilizing the apparatus disclosed in FIGS. 7–10 which comprises positioning a first receptacle 266 within the first receptacle orifice 226 formed on the first receptacle receiver 212, wherein the first multi-lumen cannula 228 is located within the first receptacle 266 and in communication with material stored therein. A second receptacle 268 is positioned within the second receptacle orifice 240 and contacts the pressurization piston 242. The user forcibly advances the second receptacle receiver 214 over the second receptacle 268, resulting in the insertion of the second multi-lumen cannula 250 into the second receptacle 266. Simultaneously, advancement of the second receptacle receiver 214 over the second receptacle 268 advances the pressurization piston 242 towards the second receptacle stop 236, thereby decreasing the effective volume of the compression chamber 244. The ambient gas being displaced by the compression chamber's decreasing volume is directed into the first receptacle 266 through the pressurization lumen 258. A pressurization differential is created between the first and second receptacles, wherein the first receptacle 266 incurs a positive pressure. The pressure differential results in the first component contained within the first receptacle 266 traversing the withdrawal port 232 and the transfer lumen 260, thereby entering the second receptacle 268 through the material transfer port 254. During the reconstitution procedure the second receptacle 268 utilizes the venting port 256 connected to the venting orifice 264 to equalize pressure within the second receptacle 268.

In closing, it is noted that specific illustrative embodiments of the invention have been disclosed hereinabove. However, it is to be understood that the invention is not limited to these specific embodiments. Accordingly, the invention is not limited to the precise embodiments described in detail hereinabove. Those skilled in the art will appreciate the benefits advanced by the present invention. For example, no material transfer between the receptacles will occur until a pressure differential is established. Also, with respect to the first disclosed embodiment, the material transfer occurs within a sealed environment, therefor the likelihood of contamination is greatly reduced. With respect to the claims, it is applicant's intention that the claims not be interpreted in accordance with the sixth paragraph of 35 U.S.C. § 112 unless the term "means" is used followed by a functional statement. Further, with respect to the claims, it should be understood that any of the claims described below can be combined for the purposes of the invention.

What is claimed is:

1. A reconstitution device, comprising:

a first receptacle receiver having a first component cannula disposed therein, said first component cannula having a material flow lumen therethrough and having at least a first transfer port formed thereon and in communication with said material flow lumen, said first component cannula having a pointed tip;

a second receptacle receiver connected to said first receptacle receiver, said second receptacle receiver having a second component cannula disposed therein and wherein said material flow lumen traverses through said second component cannula, said second component cannula having a second transfer port formed thereon and in communication with said material flow lumen, said second component cannula having a second pointed tip;

a pressure lumen formed within at least one of said first component cannula and said second component cannula;

a pressure port formed on at least one of said first component cannula and said second component cannula and in fluid communication with pressure lumen; and a user-controllable source of pressure in fluid communication with said pressure lumen.

2. The reconstitution device of claim 1, wherein the pressure source is a source of positive pressure.

3. The reconstitution device of claim 2, further comprising a chamber between said first receptacle receiver and said second receptacle receiver and wherein said pressure source comprises a piston residing in said chamber and said pressure lumen is in fluid communication with said chamber.

4. The reconstitution device of claim 3, wherein said chamber is capable of compression, thereby introducing a positive pressure to said first receptacle through said pressure lumen.

5. The reconstitution device of claim 1, wherein the pressure source is a source of negative pressure.

6. The reconstitution device of claim 5, wherein the negative pressure source is a syringe.

7. The reconstitution device of claim 5, wherein the negative pressure source is an external vacuum source.

8. The reconstitution device of claim 1, wherein the pressure source is a source of positive pressure created in a first receptacle and a source of negative pressure created in a second receptacle.

9. A reconstitution device, comprising:

a first receptacle receiver having a first component cannula disposed therein, said first component cannula having a material flow lumen therethrough and having at least a first transfer port formed thereon and in communication with said material flow lumen, said first component cannula having a pointed tip;

a second receptacle receiver connected to said first receptacle receiver, said second receptacle receiver having a second component cannula disposed therein and wherein said material flow lumen traverses through said second component cannula, said second component cannula having a second transfer port formed thereon and in communication with said material flow lumen, said second component cannula having a second pointed tip;

a pressure lumen formed within said second component cannula;

a pressure port formed on said second component cannula and in fluid communication with pressure lumen; and a user-controllable source of pressure in fluid communication with said pressure lumen.

10. The reconstitution device of claim 9, wherein said pressure source is a source of negative pressure.

11. The reconstitution device of claim 10, wherein the negative pressure source is a syringe connected to the device through an externally accessible orifice in communication with said pressure lumen.

12. The reconstitution device of claim 9, wherein said first receptacle receiver comprises a first receptacle stop and at least first receptacle support member attached thereto.

13. The reconstitution device of claim 12, wherein at least one receptacle locking member is positioned on said first receptacle support member.

14. A reconstitution device, comprising:

a first receptacle receiver having a first component cannula disposed therein, said first component cannula having a material flow lumen therethrough and having at least a first transfer port formed thereon and in communication with said material flow lumen, said first component cannula having a pointed tip;

a second receptacle receiver connected to said first receptacle receiver, said second receptacle receiver having a second component cannula disposed therein and wherein said material flow lumen traverses through said second component cannula, said second component cannula having a second transfer port formed thereon and in communication with said material flow lumen, said second component cannula having a second pointed tip;

a pressure lumen formed within said first component cannula;

a pressure port formed on said first component cannula and in fluid communication with pressure lumen; and a user-controllable source of pressure in fluid communication with said pressure lumen.

15. The reconstitution device of claim 14, wherein the pressure source is a source of positive pressure.

16. The reconstitution device of claim 15, further comprising a chamber between said first receptacle receiver and said second receptacle receiver and wherein said pressure source comprises a piston residing in said chamber and said pressure lumen is in fluid communication with said chamber.

17. The reconstitution device of claim 16, wherein said chamber is capable of compression, thereby introducing a positive pressure to said first receptacle through said pressure lumen.

* * * * *